US012702935B2

(12) United States Patent
Kamiyama

(10) Patent No.: US 12,702,935 B2
(45) Date of Patent: Aug. 11, 2026

(54) FIGURE HOLDER

(71) Applicant: EPOCH COMPANY, LTD., Tokyo (JP)

(72) Inventor: Kei Kamiyama, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 136 days.

(21) Appl. No.: 17/978,506

(22) Filed: Nov. 1, 2022

(65) Prior Publication Data

US 2023/0137196 A1 May 4, 2023

(30) Foreign Application Priority Data

Nov. 2, 2021 (JP) ..... 2021-179543

(51) Int. Cl.
*A63H 3/50* (2006.01)

(52) U.S. Cl.
CPC ..... *A63H 3/50* (2013.01)

(58) Field of Classification Search
CPC ..... A63H 3/50
USPC ..... D21/503; D8/382; 24/530, 532
See application file for complete search history.

(56) References Cited

U.S. PATENT DOCUMENTS 220,606 A * 10/1879 Goye ..... A63H 7/04 446/279
1,746,839 A * 2/1930 Main ..... A63H 3/16 D21/620
2,527,152 A * 10/1950 Ransom ..... A47F 7/00 446/268
2,662,335 A * 12/1953 Calverley ..... A63H 3/16 446/99

(Continued)

FOREIGN PATENT DOCUMENTS

CN 102099087 A 6/2011
CN 103596630 A 2/2014

(Continued)

OTHER PUBLICATIONS

First Chinese Office Action issued Jul. 24, 2025 in Application No. 202211360528.0.

(Continued)

*Primary Examiner* — Michael D Dennis
*Assistant Examiner* — Matthew B Stanczak
(74) *Attorney, Agent, or Firm* — Faegre Drinker Biddle & Reath LLP

(57) ABSTRACT

A figure holder includes a support portion, two bulging portions, two linear portions, and two curved holding portions. The support portion includes an engaging portion configured to engage an attachment surface. The two bulging portions are formed on the support portion so as to bulge. The two bulging portions face each other. The two linear portions linearly extend from the respective two bulging portions toward a front end side with an interval therebetween. The two curved holding portions are provided to face each other and extend from the respective two linear portions toward the front end side so as to define an outwardly convex curved shape. The two curved holding portions include facing portions, respectively. The facing portions are formed in a concave curved shape and configured to hold a figure.

8 Claims, 6 Drawing Sheets

(56) References Cited

U.S. PATENT DOCUMENTS 2,752,726 A * 7/1956 Calverley ..... F16C 11/06 446/99
2,807,431 A * 9/1957 Mchale ..... B44D 3/123 248/113
2,820,324 A * 1/1958 Echelmeier ..... A63H 3/50 446/279
2,919,877 A * 1/1960 Gallagher ..... A63H 3/50 248/125.3
D199,089 S * 9/1964 Boden et al. ..... D8/396
3,207,094 A * 9/1965 Kass ..... A63H 3/50 108/50.12
3,345,030 A * 10/1967 Speers ..... A63H 3/50 248/346.03
3,392,480 A * 7/1968 Stubbmann ..... A63H 33/08 446/101
3,512,741 A * 5/1970 Goldstein ..... A47F 8/00 446/268
3,516,632 A * 6/1970 Hall ..... A47F 8/00 248/176.1
3,675,362 A * 7/1972 De Gelder ..... A63H 7/04 446/366
3,698,123 A * 10/1972 Heldt ..... A63H 33/101 446/120
3,699,712 A * 10/1972 Handler ..... A63H 13/18 248/346.04
3,713,251 A * 1/1973 Marason, Jr. ..... A63H 3/50 446/241
3,998,002 A * 12/1976 Nathanson ..... A63H 33/105 446/115
4,087,932 A * 5/1978 Rosenthal ..... A63H 3/50 446/315
4,091,563 A * 5/1978 Noble ..... A63H 13/06 446/334
4,127,251 A * 11/1978 Sapkus ..... A63H 3/50 248/176.1
D250,631 S * 12/1978 Stephenson ..... D8/355
4,141,176 A * 2/1979 Flicker ..... A63H 13/00 446/361
D257,950 S * 1/1981 Van Meter, Jr. ..... D8/395
4,244,136 A * 1/1981 Kublan ..... A63H 3/50 446/228
4,274,224 A * 6/1981 Pugh ..... A63H 3/16 446/383
4,352,255 A * 10/1982 Warehime ..... F16B 7/0493 446/124
D269,156 S * 5/1983 Slinkard ..... D8/395
4,434,535 A * 3/1984 Woodley ..... D06F 55/00 24/562
4,548,590 A * 10/1985 Green ..... A63H 33/065 446/116
4,571,198 A * 2/1986 Barbato ..... A63H 3/50 446/368
4,573,940 A * 3/1986 Showers ..... A63H 3/50 446/376
4,706,915 A * 11/1987 Cindric ..... A63H 3/50 248/161
4,758,196 A * 7/1988 Wang ..... A63H 33/08 52/645
4,821,988 A * 4/1989 Jimenez ..... A61G 7/0503 D8/395
D305,920 S * 2/1990 Butler ..... D21/658
D306,553 S * 3/1990 Rumpel ..... D8/395
4,992,070 A * 2/1991 Mullen ..... A63H 3/14 446/367
5,014,939 A * 5/1991 Kraus ..... F16B 2/22 248/70
D338,613 S * 8/1993 Hoover ..... D8/373
5,398,820 A * 3/1995 Kiss ..... A47F 5/0884 211/89.01
D363,017 S * 10/1995 Noble ..... D9/434
D363,959 S * 11/1995 Grubbs ..... D21/658
D366,609 S * 1/1996 McDonald ..... D8/395
5,549,499 A * 8/1996 Foskey ..... A63H 3/50 446/268
5,551,656 A * 9/1996 De Lozada ..... A63H 3/50 248/176.1
5,601,471 A * 2/1997 Kennedy ..... A63H 3/50 446/268
5,605,232 A * 2/1997 Bickle ..... A45C 3/001 206/754
D389,050 S * 1/1998 Li ..... D8/395
D393,417 S * 4/1998 Glickman ..... D8/382
5,775,970 A * 7/1998 Klees ..... A63H 3/50 472/64
D402,396 S * 12/1998 Protz, Jr. ..... D8/395
5,897,417 A * 4/1999 Grey ..... F16M 11/14 403/90
D410,705 S * 6/1999 Toft ..... D21/493
5,913,706 A * 6/1999 Glickman ..... A63H 3/16 446/99
5,967,470 A * 10/1999 Guschlbauer ..... A63H 3/50 248/176.1
D417,612 S * 12/1999 Jones ..... D8/395
D435,684 S * 12/2000 Gary ..... D8/395
6,257,532 B1 * 7/2001 Ives ..... A47F 7/0028 248/146
6,264,525 B1 * 7/2001 Guschlbauer ..... A63H 3/50 446/268
D451,007 S * 11/2001 Jones ..... D8/367
6,408,492 B1 * 6/2002 Sparks ..... A01K 97/08 24/336
6,478,653 B1 * 11/2002 Langton ..... A63H 3/46 446/373
6,739,936 B1 * 5/2004 Cotilletta ..... A63H 3/50 248/219.2
6,746,298 B1 * 6/2004 Doepner ..... A63H 18/14 446/446
D515,411 S * 2/2006 Kearl ..... D8/395
D516,402 S * 3/2006 Gates ..... B60R 11/00 D8/71
D553,203 S * 10/2007 Glickman ..... D21/487
D553,204 S * 10/2007 Glickman ..... D21/487
7,527,012 B2 * 5/2009 Kutny Splaine ..... B63B 25/002 24/339
D613,921 S * 4/2010 Tsui ..... D32/54
D625,996 S * 10/2010 Witty ..... D9/434
8,087,970 B2 * 1/2012 Sambenedetto ..... A63H 3/16 446/85
8,172,636 B1 * 5/2012 Carbonero ..... A63B 19/04 446/120
D675,086 S * 1/2013 Gary ..... D8/395
D696,732 S * 12/2013 Mimlitch, III ..... D21/565
8,777,170 B2 * 7/2014 Gilbert ..... A47F 7/00 24/3.12
D711,972 S * 8/2014 Norman ..... D21/487
D711,973 S * 8/2014 Norman ..... D21/487
D715,871 S * 10/2014 Norman ..... D21/487
D744,817 S * 12/2015 Hyakutake ..... D8/382
9,549,616 B2 * 1/2017 Schilligo ..... A47C 7/624
D811,861 S * 3/2018 Ravassa ..... D8/367
10,046,883 B1 8/2018 Lui et al.
D831,743 S * 10/2018 Prince ..... D19/105
D844,485 S * 4/2019 Siegel ..... D11/164
D850,811 S * 6/2019 Alluigi ..... D9/434
D850,897 S * 6/2019 Vandenberg ..... D8/382
D856,791 S * 8/2019 Limber ..... D8/395
D859,972 S * 9/2019 Pulsipher ..... D8/395
D877,263 S * 3/2020 Cochella ..... D21/484
D931,947 S * 9/2021 Wang ..... D21/494
11,826,668 B2 * 11/2023 Klein ..... G09B 1/32
D1,050,283 S * 11/2024 Nakanishi ..... D21/685
D1,112,524 S * 2/2026 Nakanishi ..... D21/658
2003/0205842 A1 * 11/2003 Lee ..... A63H 3/46 264/261
2004/0248499 A1 * 12/2004 Costa ..... A63H 3/50 446/376
2005/0039392 A1 2/2005 Sheehan
2006/0264147 A1 * 11/2006 Shoptaugh ..... A63H 33/042 446/124

(56) References Cited

U.S. PATENT DOCUMENTS

| | | | | |
|---|---|---|---|---|
| 2007/0287356 | A1* | 12/2007 | Kane | A63H 13/12 446/330 |
| 2009/0117818 | A1* | 5/2009 | Leynes | A63H 3/50 446/268 |
| 2009/0264045 | A1 | 10/2009 | Hardin | |
| 2010/0109279 | A1* | 5/2010 | Leynes | B62J 50/40 280/202 |
| 2012/0119039 | A1 | 5/2012 | Kim | |
| 2012/0178337 | A1* | 7/2012 | Wittenberg | A63H 3/50 446/268 |
| 2012/0261282 | A1 | 10/2012 | Lui et al. | |
| 2012/0322338 | A1* | 12/2012 | Gilbert | A47F 7/00 446/73 |
| 2016/0033076 | A1* | 2/2016 | Hoeltge | F16B 47/003 248/205.3 |
| 2016/0327202 | A1* | 11/2016 | Hoeltge | A63H 3/50 |
| 2020/0398174 | A1* | 12/2020 | van Rijn | A63H 33/42 |
| 2023/0137196 | A1* | 5/2023 | Kamiyama | A63H 3/50 446/268 |
| 2025/0170492 | A1* | 5/2025 | Kamiyama | A63H 3/50 |

FOREIGN PATENT DOCUMENTS

| | | | |
|---|---|---|---|
| CN | 107930143 | A | 4/2018 |
| GB | 2327367 | A | 1/1999 |
| JP | 3058734 | U | 6/1999 |
| JP | 3059747 | U | 7/1999 |
| JP | 3066856 | U | 3/2000 |
| JP | 3154322 | U | 10/2009 |
| JP | 3165309 | U | 1/2011 |
| JP | 2020-168550 | A | 10/2020 |
| JP | 2021-151405 | A | 9/2021 |

OTHER PUBLICATIONS

Office Action issued in related application JP 2021-179543, Oct. 28, 2025, with machine generated English language translation, 8 pages.

* cited by examiner

FIGURE HOLDER

CROSS-REFERENCE TO RELATED APPLICATIONS

This application is based on and claims priority under 35 USC 119 from Japanese Patent Application No. 2021-179543 filed on Nov. 2, 2021, the contents of which are incorporated herein by reference.

TECHNICAL FIELD

The present disclosure relates to a figure holder that can hold a figure to play with and display the figure.

BACKGROUND ART

In the related art, a figure holder that holds a figure to play with and display the figure has been provided. For example, a figure holder disclosed in JP3059747U includes two elastically deformable arms that are convexly curved outward. The arm is provided on a holder that is slidably provided on a bendable support column.

SUMMARY OF INVENTION

A child who is a user may play with a plurality of types of figures. Then, since the arm formed in a convexly curved shape in the related art holds the figure with a constant elastic force, figure holders adapted to a plurality of types of figures may be prepared for a plurality of types of figures.

An object of the present disclosure is to provide a figure holder corresponding to a plurality of types of figures having different shapes and sizes.

The present disclosure provides a figure holder including: a support portion including an engaging portion configured to engage an attachment surface; two bulging portions formed on the support portion so as to bulge, the two bulging portions facing each other; two linear portions linearly extending from the respective two bulging portions toward a front end side with an interval therebetween; and two curved holding portions provided to face each other and extending from the respective two linear portions toward the front end side so as to define an outwardly convex curved shape, the two curved holding portions including facing portions, respectively, the facing portion being formed in a concave curved shape and configured to hold a figure.

According to the above aspect, it is possible to provide the figure holder corresponding to the plurality of types of figures having the different shapes and sizes.

DESCRIPTION OF EMBODIMENTS

First Embodiment

Figure 1:
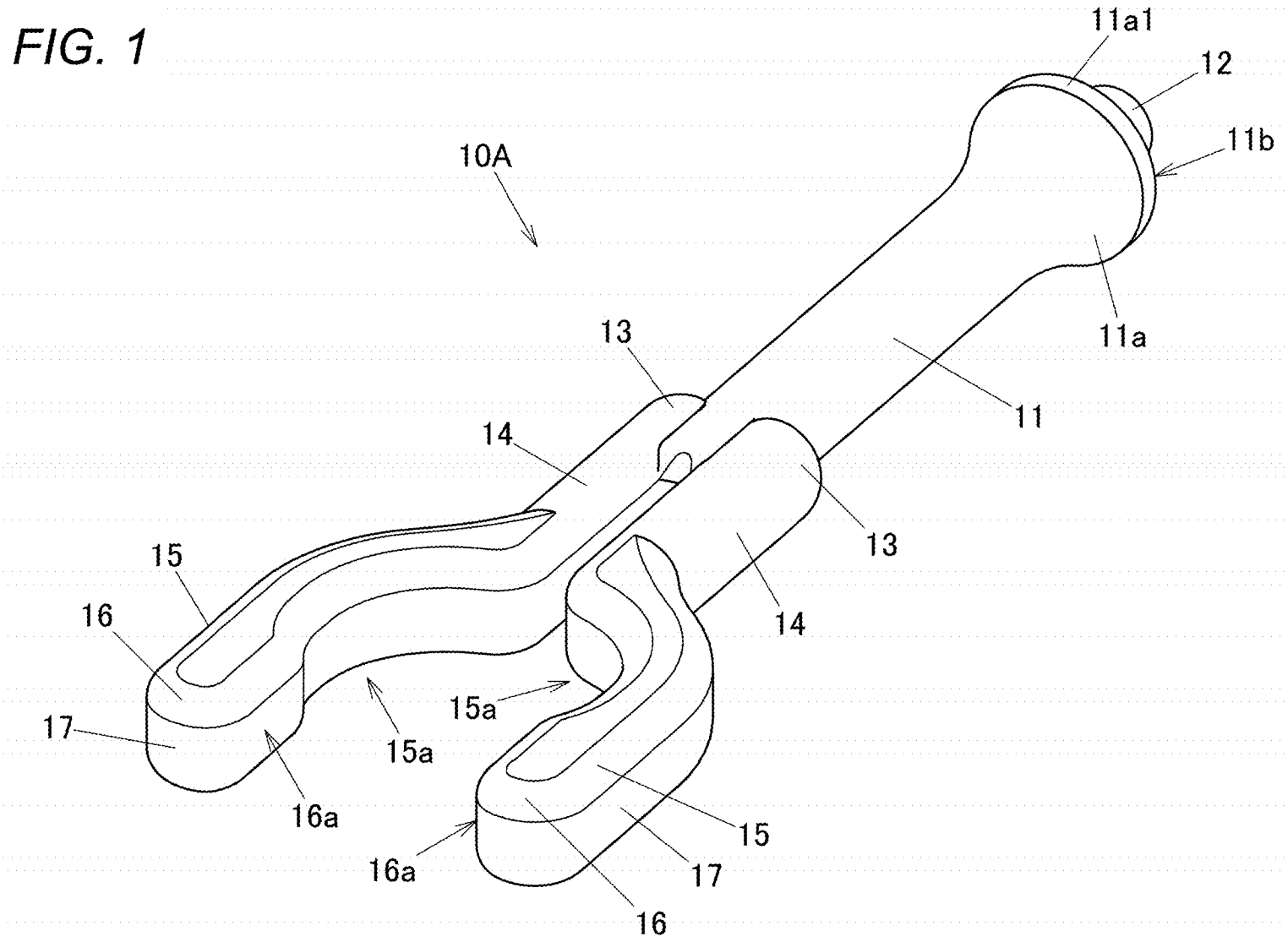
FIG. 1 is a perspective view of a figure holder according to a first embodiment of the present disclosure.
Figure 2:
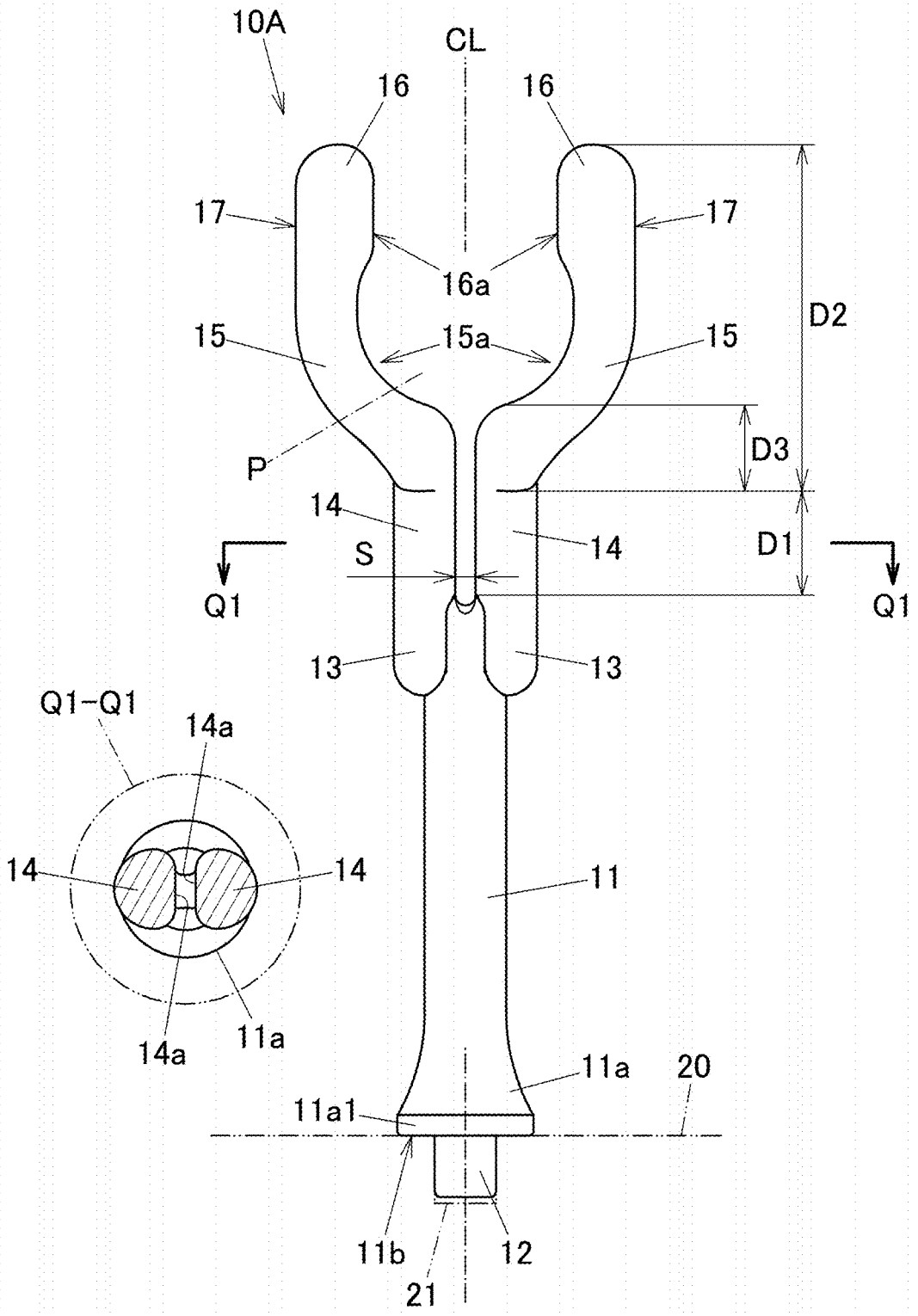
FIG. 2 is a plan view of the figure holder according to the first embodiment of the present disclosure.

A figure holder 10A according to a first embodiment of the present disclosure will be described with reference to FIGS. 1 and 2. The figure holder 10A is a figure fixing member that can hold a figure (not shown) by sandwiching the figure with a bifurcated curved holding portion 15 provided on a front end side and being fixed to an attachment surface 20 with an engaging portion 12.

More specifically, the figure holder 10A includes a support portion 11 formed in a substantially cylindrical rod shape. A diameter of a base end portion 11*a* of the support portion 11 is gradually increased, and the base end portion 11*a* is formed to have the same diameter at an edge portion 11*a*1. The engaging portion 12 protruding in a substantially columnar boss shape is provided on an end surface 11*b* of the base end portion 11*a*. As shown in FIG. 2, the engaging portion 12 is pressed and inserted into a hole-shaped engaged portion 21 provided on the attachment surface 20 to an extent that the engaging portion 12 can be freely attached to and detached from the engaged portion 21, so that the engaging portion 12 is fitted, in a concave-convex manner, to the engaged portion 21. Since the end surface 11*b* has a larger area than a main body portion of the support portion 11, it is possible to reduce a surface pressure of the end surface 11*b* with respect to the attachment surface 20. Therefore, it is possible to reduce damage such as a recess on the attachment surface 20 due to the end surface 11*b*.

On the front end side of the support portion 11, two bulging portions 13 that bulge so as to face each other with the support portion 11 interposed therebetween are provided. Two linear portions 14, which are continuous with the bulging portions 13 and extend linearly from the bulging portions 13 toward front ends with a predetermined interval S in a substantially slit shape, are provided on the front end sides of the bulging portions 13, respectively. As shown in a surrounding view of a cross section taken along a line Q1-Q1 in FIG. 2, in each of the linear portions 14, an outer side surface thereof is formed in a convex curved shape, and a surface thereof facing the outer side surface is formed as a flat surface 14*a*.

On the front end sides of the linear portions 14, two curved holding portions 15 are respectively provided which extend outward in a convex curved shape from the linear portions 14 toward the front ends and face each other. In each of the curved holding portions 15, a facing portion 15*a* in which a figure is sandwiched and held is formed in a substantially concave curved shape. Further, on the front end sides of the curved holding portions 15, two front end bulging portions 16, which are formed to be bulged in a direction in which the front end bulging portions 16 face each other, are provided. The two front end bulging portions 16 have respectively flat front end flat portions 16*a* facing each other at portions where the two front end bulging portions 16 faces each other.

The flat surface 14*a* of the linear portion 14 is provided so as to be continuous with the facing portion 15*a* of the corresponding curved holding portion 15, and the facing portion 15*a* is provided so as to be continuous with the front end flat portion 16*a* of the corresponding front end bulging portion 16. The front end flat portion 16*a* is provided so as to be continuous with an outer side surface portion 17 including a front end surface and an outer side surface of the corresponding front end bulging portion 16 and an outer side surface of the corresponding curved holding portion 15.

Here, a length D1 of the linear portion 14 in an axial direction is shorter than a length D2 of the curved holding portion 15 and the front end bulging portion 16 in the axial direction. Note that the axial direction is an axial direction along an axial center CL of the figure holder 10A. In addition, a cross-sectional area of the linear portion 14 (see the cross-sectional view taken along the line Q1-Q1 in FIG. 2) is smaller than a cross-sectional area of the curved holding portion 15 (for example, a cross-sectional area of a P portion) excluding a cross section of a portion of the curved holding portion 15 corresponding to the predetermined interval S and an exit portion of the predetermined interval S (a base end portion of the curved holding portion 15 in a range indicated by a dimension D3). The interval S extending a length D1 of each of the two linear portions 14. Further, the base end portion of the curved holding portion 15 in the range indicated by the dimension D3 has a larger cross-sectional area and higher rigidity than a portion other than the base end portion of the curved holding portion 15 and the linear portion 14.

Therefore, in a case where a force in a direction in which the curved holding portions 15 open is applied to the curved holding portions 15, since the length D2 of each of the curved holding portions 15 is longer than the length D1 of each of the linear portions 14, the cross-sectional area of each of the linear portions 14 is smaller than that of the P portion of each of the curved holding portions 15, and the base end portion of each of the curved holding portions 15 has high rigidity, while deformation of the curved holding portions 15 remains slight, elastic forces of the linear portions 14 act to open the curved holding portions 15. Then, when opening amounts of the linear portions 14 (that is, the elastic forces of the linear portions 14) exceed a certain interval (force), elastic forces of the portions other than the base end portions of the curved holding portions 15 act to open the curved holding portions 15.

That is, the elastic force of the linear portion 14 is formed to be smaller than the elastic force of the curved holding portion 15. Therefore, when the figure holder 10A is inserted so that a body portion or the like of the figure is sandwiched between the front end bulging portions 16, the curved holding portions 15 and the linear portions 14 are opened so as to be separated from each other against the elastic forces. Here, in a case of a small figure, the linear portions 14 are opened while shapes of the curved holding portions 15 are maintained, and the figure is held by the facing portions 15*a* with a predetermined elastic force. On the other hand, in a case of a large figure, the linear portions 14 are opened, and the facing portions 15*a* of the curved holding portions 15 are deformed so as to extend (so as to increase radii of the facing concave curved portions), and the facing portions 15*a* fit the large figure to hold the figure. In this way, according to the figure holder 10A, it is possible to reliably hold a small figure or a large figure.

At this time, the front end bulging portions 16 can hold down the figure so that the figure held by the facing portions 15*a* is not pushed forward.

Since the front end flat portions 16*a* are respectively provided in the front end bulging portions 16, when the figure is inserted between the front end flat portions 16*a*, it is possible to reduce the surface pressure of a portion (front end flat portion 16*a*) of the front end bulging portion 16 that comes into contact with the figure. Therefore, damage such as damage to a surface of the figure is reduced. In particular, in a figure having a flocked surface (more preferably, an electrostatic flocked surface of a short fiber), a loss of the flocked portion is reduced.

In addition, the support portion 11, the bulging portion 13, and the linear portion 14 are formed along the axial center CL, and the curved holding portion 15 is formed in a convex curved shape in a direction in which the bulging portion 13 bulges. Therefore, when the figure holder 10A holding the figure is attached to the attachment surface 20 and the figure (figure holder 10A) is viewed from the front end side of the figure holder 10A, a front end portion of the figure holder 10A is only slightly visible, and the bulging portion 13 and the support portion 11 are hidden by the figure. Therefore, since it is possible to make the figure look as if it is floating in the air, it is possible to provide fun play for children.

Second Embodiment

Figure 3:
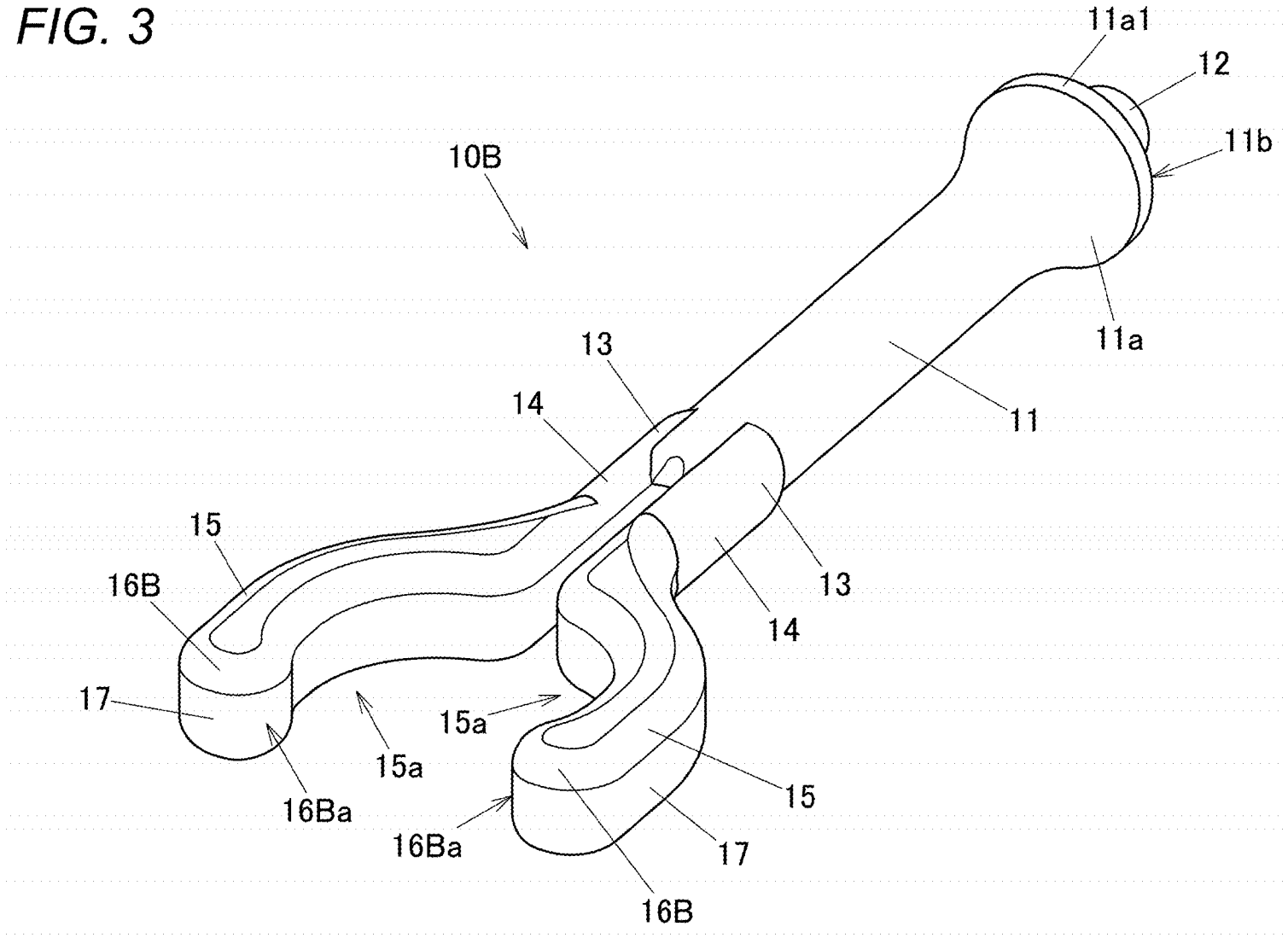
FIG. 3 is a perspective view of a figure holder according to a second embodiment of the present disclosure.
Figure 4:
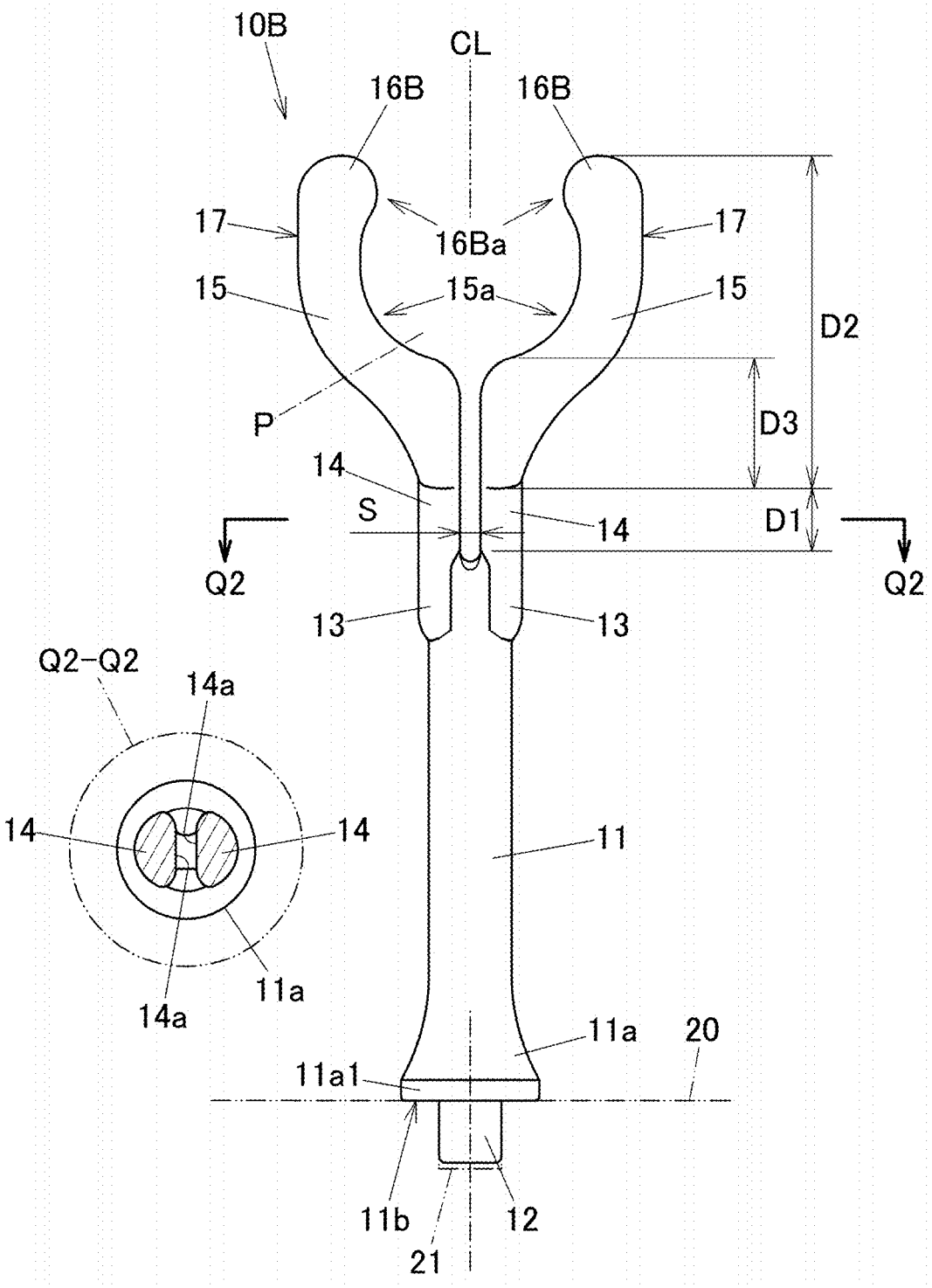
FIG. 4 is a plan view of the figure holder according to the second embodiment of the present disclosure.

Next, a second embodiment of the present disclosure will be described with reference to FIGS. 3 and 4. Note that portions that are the same as those of the figure holder 10A of the first embodiment are denoted by the same reference numerals, and a description thereof is omitted or simplified. A figure holder 10B shown in FIGS. 3 and 4 includes front end bulging portions 16B on the front end sides of the curved holding portions 15. The front end bulging portions 16B are respectively provided with convex curved portions 16Ba having a convex curved shape in a plan view at portions where the front end bulging portions 16B face each other. In addition, the cross-sectional area of the linear portion 14 (see a cross-sectional view taken along a line Q2-Q2 in FIG. 4) is formed to be sufficiently smaller than the cross-sectional area of the curved holding portion 15 (for example, the cross-sectional area of the portion P) excluding the base end portion of the curved holding portion 15 in the range indicated by the dimension D3.

Third Embodiment

Figure 5:
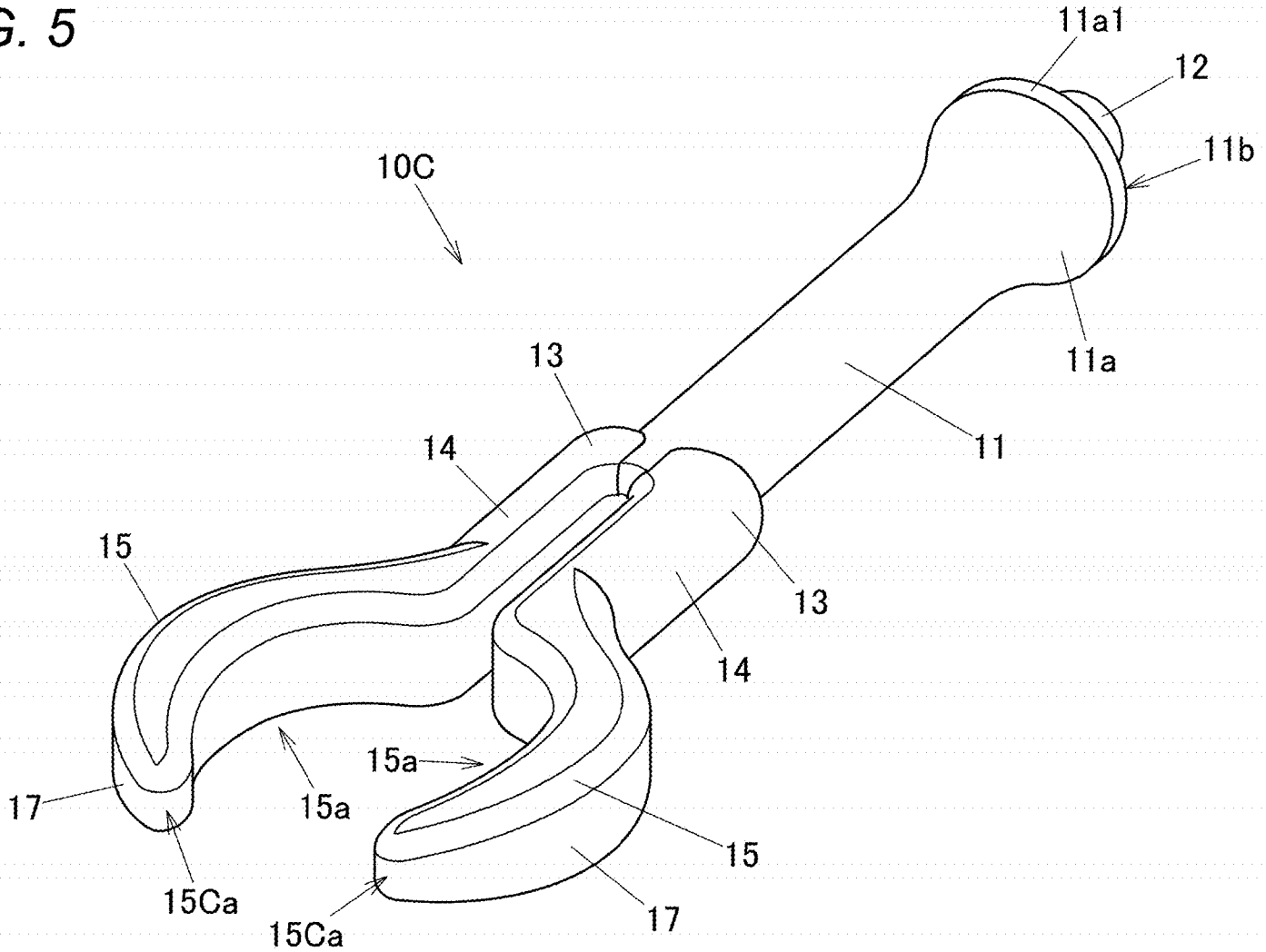
FIG. 5 is a perspective view of a figure holder according to a third embodiment of the present disclosure.
Figure 6:
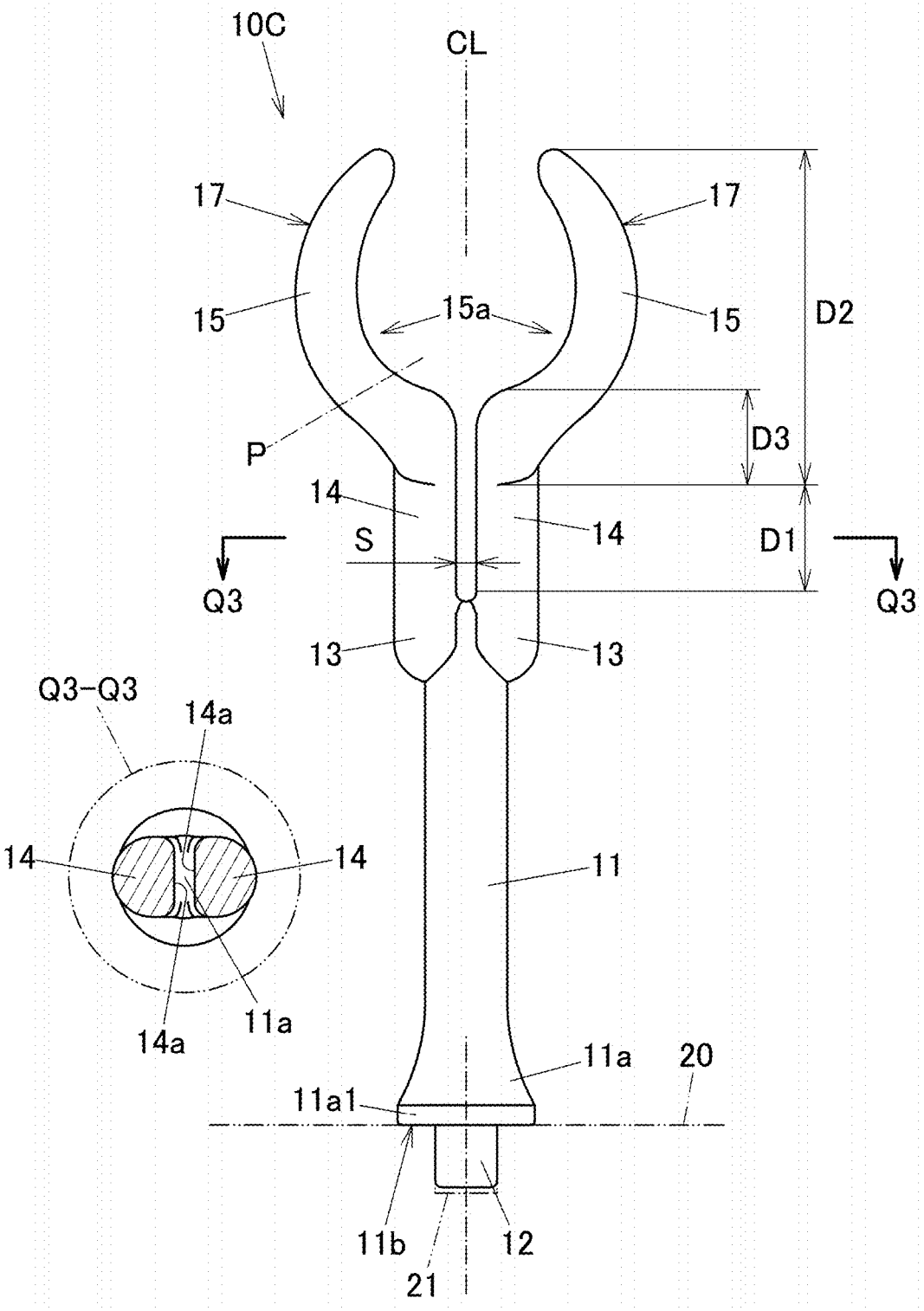
FIG. 6 is a plan view of a figure holder according to the third embodiment of the present disclosure.

Next, a third embodiment of the present disclosure will be described with reference to FIGS. 5 and 6. Note that portions that are the same as those of the figure holder 10A of the first embodiment are denoted by the same reference numerals, and a description thereof is omitted or simplified. In a figure holder 10C shown in FIGS. 5 and 6, a front end portion 15Ca of each of the curved holding portions 15 is formed in a tapered shape. In other words, the curved holding portion 15 is formed so as to be gradually reduced in both a width direction and a thickness direction in a plan view from a vicinity of a center portion (substantially a portion at a position of half the length D2) to the front end portion of the curved holding portion 15.

According to the embodiments of the present disclosure as described above, it is possible to provide a toy for a figure play in the following aspects.

A figure holder according to a first aspect includes: a support portion that includes an engaging portion configured to engage an attachment surface; two bulging portions formed directly or indirectly on the support portion so as to bulge, the two bulging portions facing each other; two linear portions linearly extending directly or indirectly from an end of the support portion and extending directly or indirectly from the respective two bulging portions toward a front end side with an interval therebetween; and two curved holding portions provided to face each other and extending directly or indirectly from the respective two linear portions toward the front end side so as to define an outward convex curved shape, the two curved holding portions including facing portions being formed in a concave curved shape and configured to hold a figure. The interval between the two linear portions may be smaller than a diameter of the support portion.

According to this configuration, it is possible to reliably hold a figure even in a case of playing with and displaying a plurality of types of figures having different shapes and sizes, such as a large figure and a small figure, by making a degree of opening different between the linear portion and the curved holding portion.

In the figure holder according to the second aspect, the two curved holding portions include two front end bulging portions, respectively, the two front end bulging portions being provided at portions of the respective two curved holding portions on the front end side than the respective facing portions, the two front end bulging portions bulging in a direction approaching each other.

According to this configuration, it is possible to hold the figure so that the figure does not protrude toward the front end side while holding a body portion or the like of the figure by the curved facing portions.

In the figure holder according to a third aspect, the two front end bulging portions include front end flat portions having flat surfaces, respectively, the front end flat portions being provided at portions of the respective two front end bulging portions where the two front end bulging portions face each other.

According to this configuration, even in a case of a figure having an easily scratched surface on which, for example, electrostatic flocking or the like is performed, a surface of the figure is prevented from being scratched when the figure is held by the figure holder.

In the figure holder according to a fourth aspect, the two front end bulging portions include convex curved portions having convex curved shapes in a plan view, respectively, the convex curved portions being provided at portions of the respective two front end bulging portions where the two front end bulging portions face each other.

According to this configuration, it is possible to hold the figure so that the figure does not protrude toward the front end side while holding a body portion or the like of the figure by the curved facing portions.

In the figure holder according to a fifth aspect, a width and a thickness of each of the two curved holding portions are gradually reduced from a center portion to a front end portion.

According to this configuration, it is possible to hold the figure so that the figure does not protrude toward the front end side while holding a body portion or the like of the figure by the curved facing portions.

In the figure holder according to the sixth aspect, an elastic force of each of the two linear portions is smaller than an elastic force of each of the two curved holding portions.

According to this configuration, for example, in a case of a small figure, the figure can be held by the elastic force of the linear portion with almost no deformation applied to the curved holding portion, and in the case of a large figure, the curved holding portion can also be deformed to hold the figure, so that it is possible to provide a figure holder that more reliably holds even a plurality of types of figures having different shapes and sizes.

Although the embodiments of the present disclosure have been described above, the present disclosure is not limited to the above-described embodiments, and various modifications can be made without departing from the scope of the present invention. For example, in the present embodiment, the convex engaging portion 12 and the concave (hole-shaped) engaged portion 21 of the attachment surface 20 are formed so as to be engaged with each other in a concave-convex manner, but a concave-convex relationship may be reversed, and another engaging method such as a screw may be used.

What is claimed is:

1. A holder comprising:

a support portion extending in an axial direction;

an engaging portion provided on an end surface of a base end portion of the support portion, configured to engage an attachment surface, and protruding in a columnar boss shape;

two bulging portions formed directly on the support portion so as to bulge, the two bulging portions facing each other;

two linear portions linearly extending directly from an end of the support portion and extending directly from the respective two bulging portions toward a front end side in the axial direction with an interval therebetween, the interval extending a length of each of the two linear portions, and each of the two linear portions having a flat surface, the flat surface of a first linear portion of the two linear portions facing the flat surface of a second linear portion of the two linear portions; and two curved holding portions provided to face each other and extending directly from the respective two linear portions toward the front end side in the axial direction so as to define an outward convex curved shape, the two curved holding portions comprising facing portions, respectively, the facing portion being formed in a concave curved shape, wherein a first length of the flat surface of each of the two linear portions in the axial direction is shorter than a second length of each of the two curved holding portions in the axial direction, a diameter of the base end portion of the support portion is gradually increased, and the end surface of the support portion has a larger area than a main body portion of the support portion.

2. The holder according to claim 1, wherein the two curved holding portions comprise two front end bulging portions, respectively, the two front end bulging portions being provided at portions of the respective two curved holding portions on the front end side of the respective facing portions, the two front end bulging portions bulging in a direction approaching each other.

3. The holder according to claim 2, wherein the two front end bulging portions comprise front end flat portions having flat surfaces, respectively, the front end flat portions being provided at portions of the respective two front end bulging portions where the two front end bulging portions face each other.

4. The holder according to claim 2, wherein the two front end bulging portions comprise convex curved portions having convex curved shapes in a plan view, respectively, the convex curved portions being provided at portions of the respective two front end bulging portions where the two front end bulging portions face each other.

5. The holder according to claim 1, wherein a width and a thickness of each of the two curved holding portions are gradually reduced from a center portion to a front end portion.

6. The holder according to claim 1, wherein an elastic force of each of the two linear portions is smaller than an elastic force of each of the two curved holding portions when a force is applied attempting to separate the two curved holding portions.

7. The holder according to claim 1, wherein the interval between the two linear portions is smaller than a diameter of the support portion.

8. The holder according to claim 1, wherein the engaging portion of the support portion extends in the axial direction.

* * * * *